US007113722B2

(12) United States Patent
Chung et al.

(10) Patent No.: US 7,113,722 B2
(45) Date of Patent: Sep. 26, 2006

(54) FUSING APPARATUS FOR AN IMAGE PHOTOGRAPHING APPARATUS AND METHOD THEREOF

(75) Inventors: Kyung-shig Chung, Suwon-si (KR); Jae-hak Lee, Gumi-si (KR); Myoung-suck Lee, Gyeongsangbuk-do (KR)

(73) Assignee: Samsung Electronics Co., Ltd., (KR)

( * ) Notice: Subject to any disclaimer, the term of this patent is extended or adjusted under 35 U.S.C. 154(b) by 0 days.

(21) Appl. No.: 11/035,987

(22) Filed: Jan. 18, 2005

(65) Prior Publication Data

US 2005/0232652 A1 Oct. 20, 2005

(30) Foreign Application Priority Data

Apr. 14, 2004 (KR) ..... 10-2004-0025626

(51) Int. Cl.
*G03G 15/00* (2006.01)

(52) U.S. Cl. ..... 399/90; 399/122; 399/328

(58) Field of Classification Search ..... 399/90
See application file for complete search history.

(56) References Cited

U.S. PATENT DOCUMENTS 4,780,078 A * 10/1988 Masui ..... 432/60
5,436,431 A * 7/1995 Tsuji et al. ..... 219/216
5,974,285 A * 10/1999 Tomatsu ..... 399/88
6,275,669 B1 8/2001 Hasegawa ..... 399/90
6,463,251 B1 10/2002 Kiuchi ..... 399/330

FOREIGN PATENT DOCUMENTS

JP 07-311507 11/1995
JP 08-272239 10/1996
JP 11-133744 5/1999

* cited by examiner

*Primary Examiner*—Arthur T. Grimley
*Assistant Examiner*—Ryan D. Walsh
(74) *Attorney, Agent, or Firm*—Roylance Abrams, Berdo & Goodman, LLP

(57) ABSTRACT

A fusing apparatus and method for an image forming apparatus comprise a housing, a first roller mounted in the housing, a second roller rotated in contact with the first roller, a heater movably mounted in at least one of the first and the second rollers and comprising a first heater and a second heater, a first power supplying terminal and a second power supplying terminal movably supported in the housing, and a pair of connection units movably supported in the housing to connect the respective heater terminals to the corresponding power supplying terminals. The power supplying terminals and the connection units have a predetermined gap with an outer surface of the housing, such that when the housing expands in a lengthwise or horizontal direction of the heater, the outer surface of the housing tightly contacts with at least one of the heater terminals, the power supplying terminals and the connection units, thereby fixing or securing the heater in the housing.

20 Claims, 6 Drawing Sheets

FUSING APPARATUS FOR AN IMAGE PHOTOGRAPHING APPARATUS AND METHOD THEREOF

CROSS-REFERENCE TO RELATED APPLICATIONS

This application claims the benefit under 35 U.S.C. 119(a) of Korean Patent Application No. 2004-25626, filed Apr. 14, 2004, in the Korean Intellectual Property Office, the disclosure of which is incorporated herein by reference.

BACKGROUND OF THE INVENTION

1. Field of the Invention

The present invention relates to a fusing apparatus for an image forming apparatus and a method thereof, which affix a toner image onto paper using a predetermined temperature and pressure. More particularly, the present invention relates to a fusing apparatus and method for securing rollers to corresponding housings when the housings expand due to the heat from the rollers.

2. Description of the Related Art

In electrophotographing image forming apparatuses such as a photocopier and a laser printer, a photoconductive medium such as a photoconductive drum is electrified by a charging unit which is adjacent to the photoconductive drum. An electrified surface of the photoconductive drum is exposed to a laser beam scanned by a laser scanning unit, in a pattern corresponding to a desired image, thereby forming an electrostatic latent image. A developing device supplies a toner to the photoconductive drum to develop the electrostatic latent image formed on the photoconductive drum into a toner image, that is, a visible image.

The visible image formed on the photoconductive drum is transferred to paper, after passing through a transfer medium. Alternatively, the visible image may be directly transferred to the printing paper without passing through the transfer medium.

The paper, to which the toner image is transferred, passes through a fusing apparatus, and accordingly, the toner image is affixed onto the paper. Paper passing through the fusing apparatus is discharged out of the image forming apparatus.

The fusing apparatus generally comprises a pressing roller and a heating roller which rotate in contact with each other. Referring to FIG. 1, the fusing apparatus comprises upper and lower housings 10 and 11 which include therein a pressing roller 13 and a heating roller 14 rotating in contact with each other. A heater 15 is mounted in the heating roller 14. One end of the heater 15 is arranged in such a manner that a first heater terminal 16 and a conductor member 17 are fastened by a first bolt 18 to the lower housing 11 altogether. The other end of the heater 15 is arranged in such a manner that a second heater terminal 21 and a connection piece 22 (see FIG. 2) are fastened by a second bolt 23 and supported by a sidewall 11*a* of the lower housing 11. The second bolt 23 is engaged with a nut 24 of which height 'b' is greater than thickness 'a' of the sidewall 11*a*. According to the above structure, although the thickness 'a' of the sidewall 11*a* decreases due to thermal expansion of the lower housing 11, fastening of the second heater terminal 21 and the connection piece 22 by the second bolt 23 can be maintained.

However, the conventional fusing apparatus as described above may lose stability when the lower housing 11 expands by heat as a whole, especially, in a horizontal direction. This is because, if the lower housing 11 horizontally expands, the heater 15 may be damaged or the heater terminals 16 and 21 are disconnected since the heater 15 and the heater terminals 16 and 21 are connected by welding.

SUMMARY OF THE INVENTION

An aspect of the present invention is to solve at least the above problems and/or disadvantages and to provide at least the advantages described below. Accordingly, an aspect of the present invention is to provide a fusing apparatus or an image forming apparatus and method for preventing damage to a heater.

In order to achieve the above-described aspects of the present invention, there is provided a fusing apparatus and method comprising a housing, a first roller mounted in the housing, a second roller rotated in contact with the first roller, a heater movably mounted in at least one of the first and the second rollers and comprising a first heater terminal and a second heater terminal, a first and a second power supplying terminals movably supported in the housing, and a pair of connection units movably supported in the housing to connect the respective heater terminals to the corresponding power supplying terminals. At least one of the heater terminals, the power supplying terminals and the connection units have a predetermined gap with an outer surface of the housing, such that when the housing expands in a horizontal direction of the heater, the outer surface of the housing tightly contacts with at least one of the heater terminals, the power supplying terminals and the connection units, thereby fixing or securing the heater in the housing.

The housing has a guide part for slidably supporting the connection unit, and the connection unit comprises a nut member movably received in the guide part, and a bolt fastened by the nut member and clamping the heater terminal and the power supplying terminal.

The nut member comprises a non-circular support engaged on the guide part in a sliding manner; and a protrusion formed on the non-circular support by a predetermined height, wherein the height of the protrusion is greater than the thickness of the guide part.

The respective connection units are able to move in the horizontal direction and in a vertical crossing the horizontal direction.

The respective connection units are able to move in the horizontal direction and in the crossing direction in a state that the heater terminal and the power supplying terminal are connected.

The gap is maintained a distance where at least one of the power supplying terminals, the heater terminals and the connection units tightly contact with the housing when expanded, such that the movement in the crossing direction of the connection unit is restricted when the housing expands in the horizontal direction.

The horizontal direction and the crossing direction are perpendicular.

A fusing apparatus for an image forming apparatus and method comprise a housing; a heating roller rotatably mounted in the housing; a heater mounted in the heating roller and having a first and a second heater terminals; a first and a second power supplying terminals supported by the housing; and a pair of connection units connecting the respective power supplying terminals to the heater terminals and movably supported by the housing. When the housing thermally expands in a horizontal direction of the heater, assuming that L1 denotes a distance between contacting portions, the contacting portions of one of the heater terminals, the power supplying terminals and the connection units respectively contacting with both outer surfaces of the housing, and L2 denotes a distance between outer surfaces on opposite sides of the housing, which contact one of the contacting terminals, L1 and L2 satisfies a following expression;

Expression $$L1-L2>0$$

The housing comprises a guide part for supporting the connection unit so that the connection unit can move in the horizontal direction and a direction crossing the horizontal direction.

Assuming that L3 is a distance of expansion in the horizontal direction of the housing by the heat of the heating roller, a following expression is satisfied;

Expression $$L1-L2=L3$$

BRIEF DESCRIPTION OF THE DRAWING FIGURES

The above aspect and other features of the present invention will become more apparent by describing in detail exemplary embodiments thereof with reference to the accompanying drawing figures, wherein.

DETAILED DESCRIPTION OF THE PREFERRED EMBODIMENTS

Figure 1:
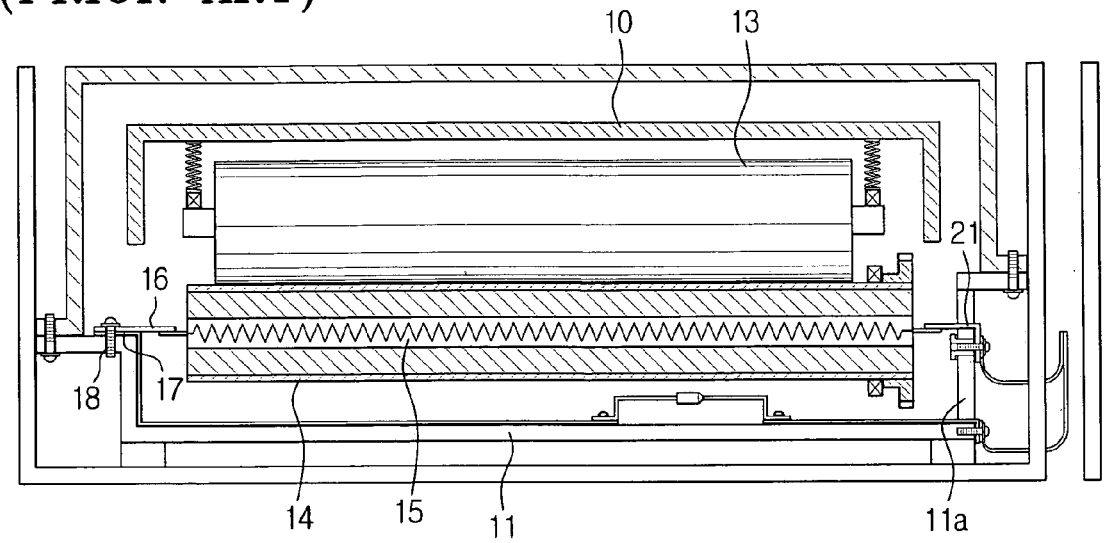
FIG. 1 (PRIOR ART)
FIG. 1 is a sectional view schematically showing the structure of a conventional fusing apparatus of an image forming apparatus.
Figure 2:
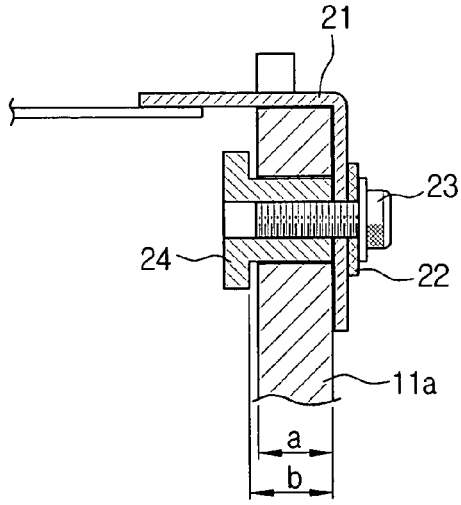
FIG. 2 (PRIOR ART)
FIG. 2 is a sectional view illustrating the main parts of FIG. 1.

Hereinafter, an embodiment of the present invention will be described in detail with reference to the accompanying drawing figures.

In the following description, the same drawing reference numerals are used for the same elements even in different drawings. The matters defined in the description such as a detailed construction and elements are exemplary. Thus, it should be apparent that the present invention can be performed without the examples. Also, well-known functions or constructions are not described in detail since they would obscure the invention in unnecessary detail.

Figure 3:
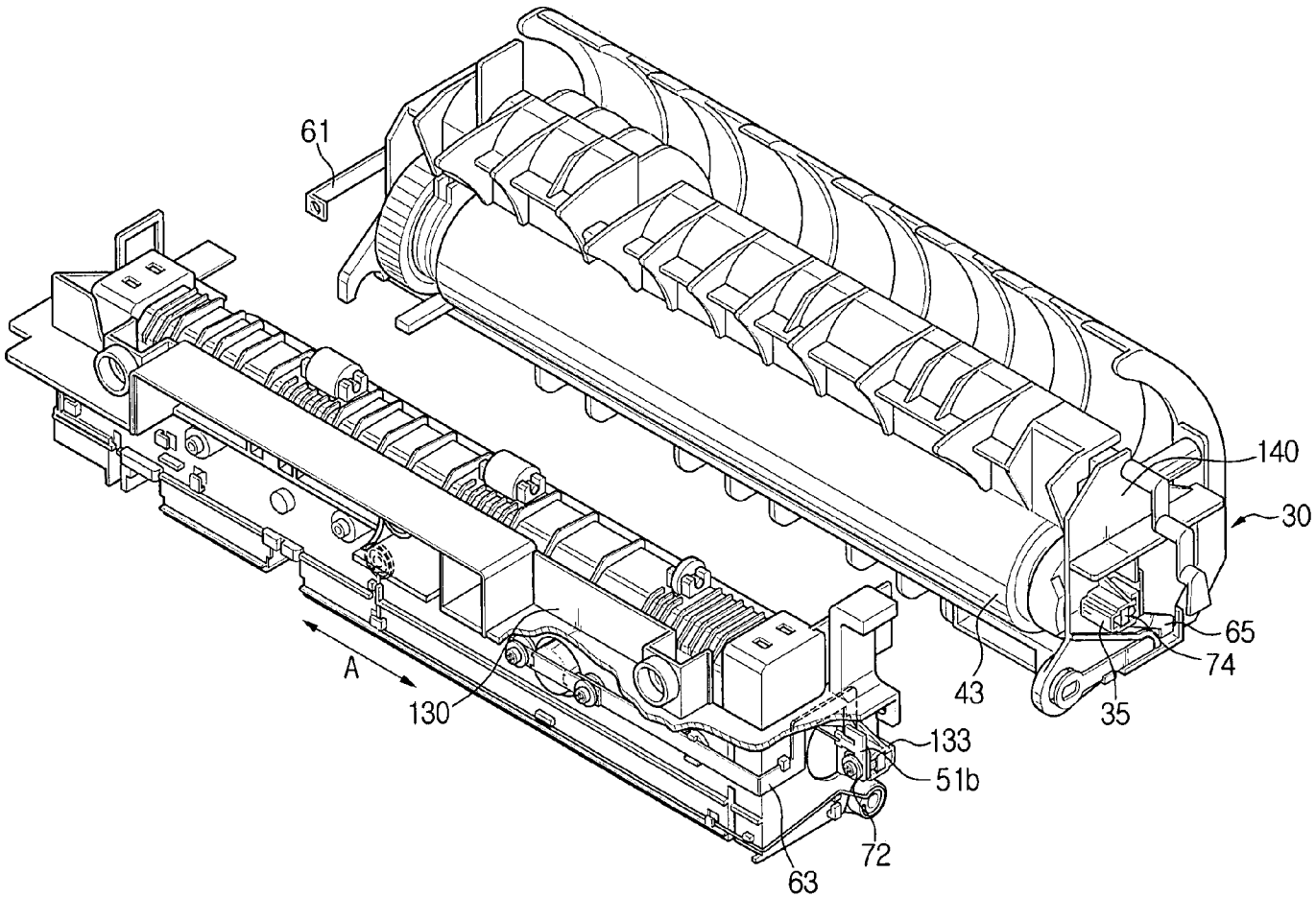
FIG. 3 is an exploded perspective view illustrating the fusing apparatus according to an embodiment of the present invention.
Figure 4:
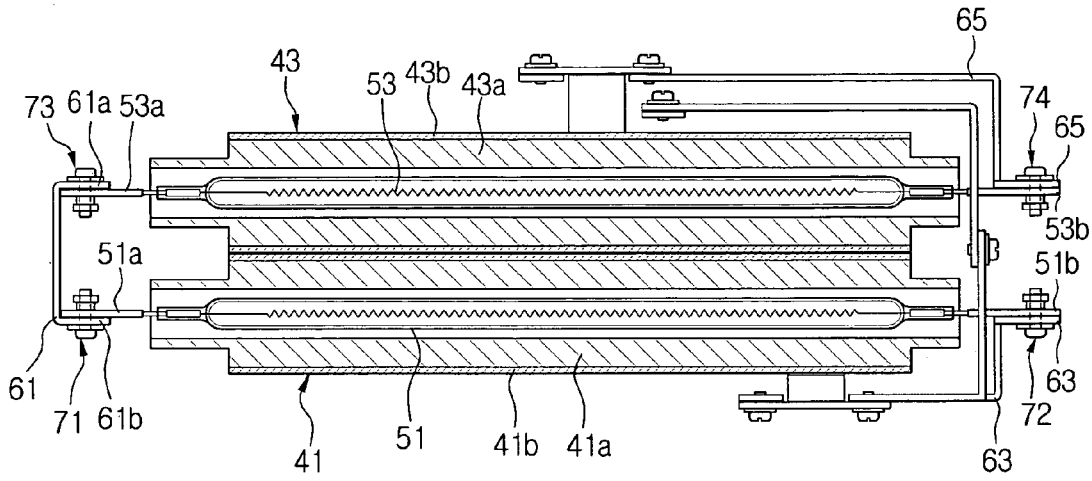
FIG. 4 is a schematic sectional view illustrating the structure of the fusing apparatus of FIG. 3.

Referring to FIGS. 3 and 4, a fusing apparatus for an image forming apparatus according to an embodiment of the present invention comprises a housing 30, a first roller 41 and a second roller 43 rotatably mounted in the housing 30, a first heater 51 and a second heater 53 respectively mounted in the first and the second rollers 41 and 43, a first power supplying terminal 61, second power supplying terminals 63 and 65, and a plurality of connection units 71, 72, 73 and 74.

The housing 30 comprises a first housing 130 and a second housing 140. The housings 130 and 140 are made by an insert molding of synthetic resin such as plastic and expand by heat and contract by cooling.

In the first and the second housings 130 and 140, the first and the second rollers 41 and 43 are respectively mounted to rotate in contact with each other. As shown in FIG. 4, the rollers 41 and 43 respectively comprise tubular roller bodies 41*a* and 43*a*, and resilient layers 41*b* and 43*b* formed on an outer circumference of the roller bodies 41*a* and 43*a*. The tubular roller bodies 41*a* and 43*a* are generally formed of aluminum which has high thermal conductivity. The tubular roller bodies 41*a* and 43*a* are respectively supported by the first and the second housings 130 and 140 by a bearing. Each end of the tubular roller bodies 41*a* and 43*a* is engaged with a plurality of gears that are meshed with one another. In printing, the rollers 41 and 43 are rotated in tight contact with each other and heated at high temperature by the heaters 51 and 53. Therefore, a toner image, being transferred onto a paper passing through between the rollers 41 and 43, is fused onto a surface of the paper by heat and pressure. The rollers 41 and 43 may comprise one heating roller 41 and one pressing roller 43. Since the structure and operation of the fusing apparatus having the heating roller 41 and the pressing roller 43 are well known, a detailed description thereof will be omitted for conciseness.

Figure 5:
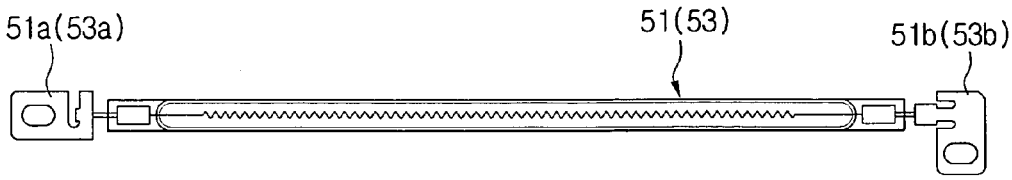
FIG. 5 is a plan view of a heater of FIG. 4.

The heaters 51 and 53 for heating the rollers 41 and 43 are mounted in the rollers 41 and 43, and more preferably, out of contact with the rollers 41 and 43. As shown in FIG. 5, the first and the second heaters 51 and 53 comprise first heater terminals 51*a* and 53*a* at one end and second heater terminals 51*b* and 53*b* at the other end. The heaters 51 and 53 are supplied with a predetermined amount of electric power through both ends, thereby generating heat for heating the rollers 41 and 43. In an embodiment of the present invention, the first heater 51 mounted in the first roller 41 is applied with higher power and accordingly heated to higher temperature than the second heater 53.

Hereinbelow, the first heater 51 generating relatively higher heat will be described in greater detail. The first heater 51 can be kept apart from the first roller 41 within the first roller 41 since the first and the second heater terminals 51*a* and 51*b* are supported by the first housing 130.

The first heater 51 may be movably supported by the first housing 130, rather than fixed. Therefore, when the first housing 130 expands by heat in a lengthwise or horizontal direction A shown in FIG. 3, the first heater 51 is not broken by the expansion but stably supported by the first housing 130.

Figure 6:
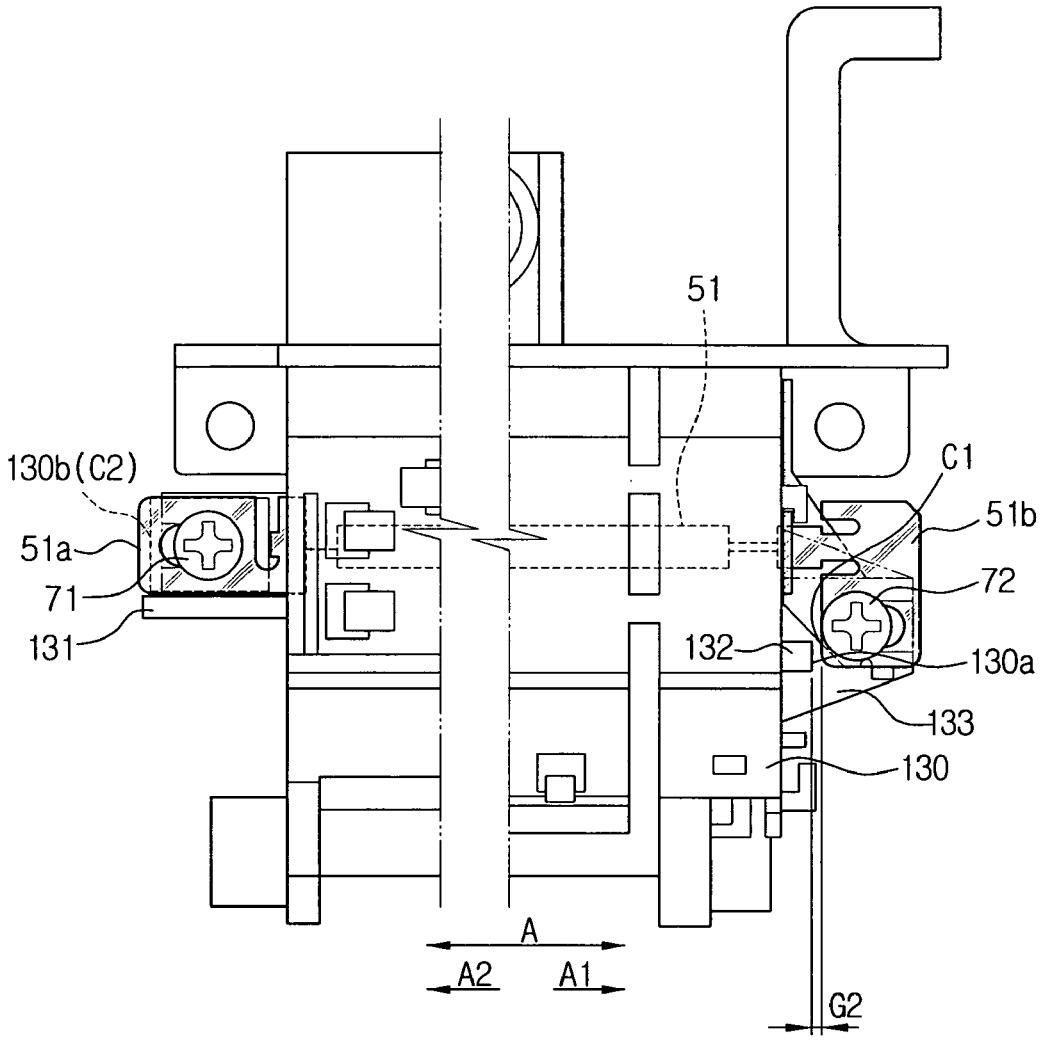
FIG. 6 is a plan view schematically illustrating a first housing of FIG. 3.

Referring to FIG. 6, the first housing 130 has at opposite ends thereof first and second guide parts 131 and 133 for movably supporting the heater terminals 51*a* and 51*b*. Since the guide parts 131 and 133 are similarly structured, only the second guide part 133 which supports the second heater terminal 51*b* will be described in detail.

Figure 7:
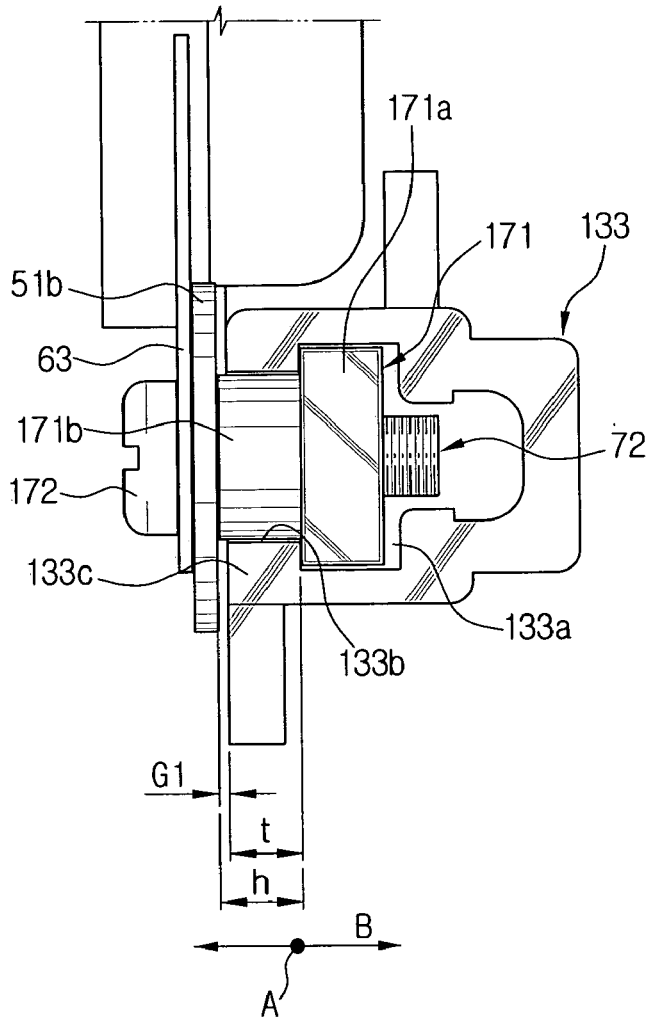
FIG. 7 is a side view of the first housing of FIG. 6.

Referring to FIG. 7, the second guide part 133 comprises a chamber 133*a* for movably receiving the second connection unit 72 and a slit 133*b*.

Figure 8:
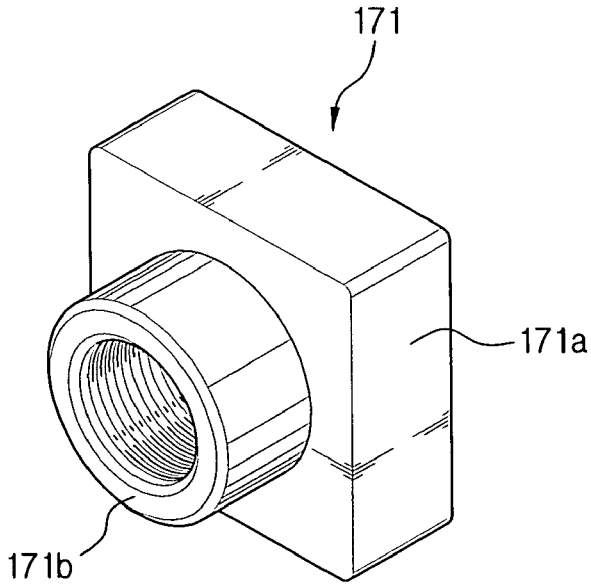
FIG. 8 is a perspective view of a nut member of a connection unit of FIG. 7.
Figure 9:
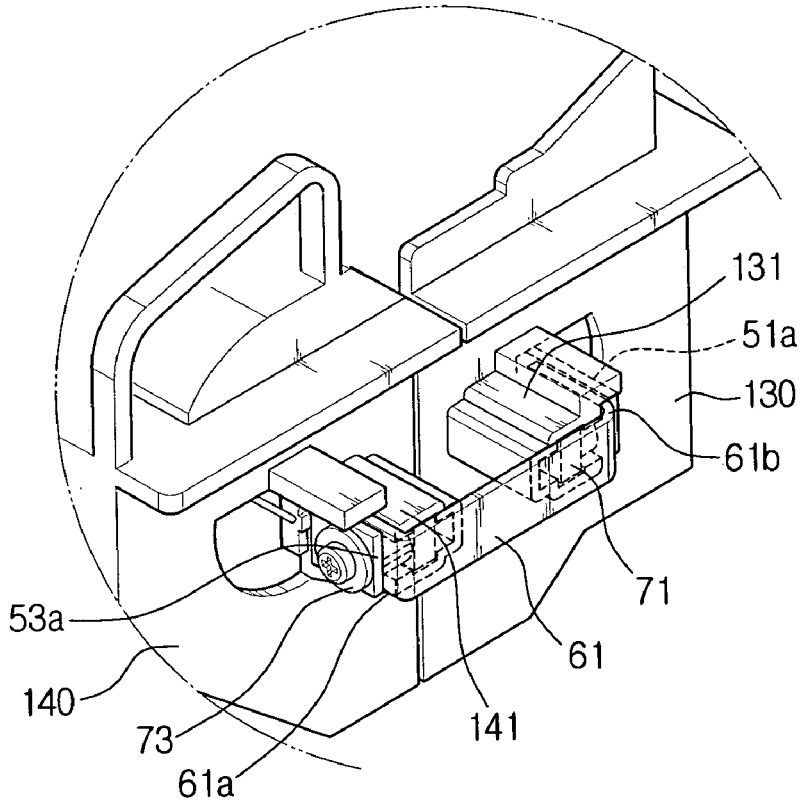
FIG. 9 is a perspective view illustrating the main parts of the fusing apparatus of FIG. 3.

The second connection unit 72 supported by the second guide part 133 connects the second heater terminal 51*b* to the second power supplying terminal 63. The second connection unit 72 is supported by the second guide part 133 so as to move by a predetermined distance. The second connection unit 72 comprises a nut member 171 received in the chamber 133*a* in a sliding manner, and a bolt 172 engaged with the nut member 171 to clamp and connect the second heater terminal 51*b* to the second power supplying terminal 63. As shown in FIG. 8, the nut member 171 comprises a non-circular support 171*a* and a protrusion 171*b* protruding from the non-circular support 171*a* by a predetermined height 'h'. The support 171*a* is slidably received in the chamber 133*a* of the guide part 133. Due to the non-circular shape of the support 171*a*, idle rotation of the nut member 171 is prevented when engaged with the bolt 172. The protrusion 171*b* is exposed to the outside through the slit 133*b* and comes into tight contact with the second power supplying terminal 63. The height 'h' of the protrusion 171*b* is greater than a thickness 't' of a support wall 133*c*. Accordingly, if the second power supplying terminal 63 and the second heater terminal 51*b* are interposed between the bolt 172 and the nut member 171, and the bolt 172 is maximally fastened, a certain gap G1 is caused due to a difference between the height 'h' and the thickness 't', in a direction B (FIG. 7). The direction B is preferably perpendicular to the direction A (FIG. 6). Although not shown, in the first guide part 131 disposed on the opposite side, a gap the same as the gap G1 is generated by the first connection unit 71 connecting the first heater terminal 51*a* of the first heater 51 to the first power supplying terminal 61.

The first connection unit 71 has a similar structure to the second connection unit 72. Therefore, a detailed description thereof will not be made.

Referring to FIG. 4, the housing 30 supports the first and the second power supplying terminals 61 and 63. The first power supplying terminal 61 is connected to the first heater terminal 51*a*, and the second power supplying terminal 63 is connected to the second heater terminal 51*b*. The first power supplying terminal 61 may be fixed by one end to the first housing 130 and connected by the other end to the first heater terminal 51*a*. In an embodiment of the present invention, the first power supplying terminal 61 is shared for serial connection of the first heater terminals 51*a* and 53*a* of the first and the second heaters 51 and 53.

More specifically, the first power supplying terminal 61 is connected by both ends respectively to the first heater terminals 51*a* and 53*a* of the heaters 51 and 53. Referring to FIGS. 4 through 9, one end 61*a* of the first power supplying terminal 61 is fixed to a guide part 141, being connected to the first heater terminal 53*a* of the second heater 53. The other end 61*b* of the first power supplying terminal 61 is movably supported by the first guide part 131, when connected to the first heater terminal 51*a* by the first connection unit 71. The third connection unit 73 supported by the guide part 141 of the second housing 140 is structured basically in the same manner as the first connection unit 71, but is fixed to the guide part 141. As a result, one end 61*a* of the first power supplying terminal 61 is fixed to the second housing 140 while the other end 61*b* is a free end.

The second power supplying terminals 63 and 65, provided in a pair, are respectively supported by the first and the second housings 130 and 140. The second power supplying terminal 65 is connected to the second heater terminal 53*b* of the second heater 53 by the fourth connection unit 74 and fixed to the second housing 140. Therefore, the second heater 53 is firmly fixed to the second housing 140.

The second power supplying terminal 63 is fixed to the first housing 130 by one end. The other end of the second power supplying terminal 63 is not fixed to the first housing 130, but supported in connection with the second heater terminal 51*b* of the first heater 51 by the second connection unit 72. As shown in FIG. 7, the second connection unit 72 is movably supported by the second guide part 133. Accordingly, the other end of the second power supplying terminal 63 and the second heater terminal 51*b* are also movably supported with respect to the first housing 130. Therefore, the first heater 51 is supported by the first housing 130 to move in the direction A (FIG. 6).

As described above, the first heater 51 is not restricted by the connection units 71 and 72, and therefore, the first heater 51 can move in the direction A relative to the first housing 130 due to the gap G1.

Furthermore, although the first housing 130 expands or contracts in a direction B (FIG. 7), displacement of the guide parts 131 and 133 can be compensated for by existence of the gap G1. Accordingly, fastening of the second power supplying terminal 63 and the second heater terminal 51*b* can be maintained.

In an embodiment of the present invention, as shown in FIG. 6, the first heater 51 is mounted so as to be able to move in the direction A with a predetermined gap G2 before the first housing 130 thermally expands. FIG. 6 shows the first heater 51 is biased to an extreme in a direction A1. In this case, the gap G2 is formed between an outer surface 130*a* on the right of the first housing 130 and a corresponding first contacting portion C1 of the second heater terminal 51*b*. When the first heater 51 is biased to an extreme in a direction of A2, the right outer surface 130*a* contacts with at least one of the second heater terminal 51*b*, the second power supplying terminal 63 and the second connection unit 72. In an embodiment of the present invention, the second heater terminal 51*b* contacts with the right outer surface 130*a* of the first housing 130. The right outer surface 130*a* is an end of a stopper 132 protruding on a top surface of the second guide part 133.

When an outer surface 130*b* on the left of the first housing 130, that is, the first heater 51 is biased to an extreme, the first power supplying terminal 61 contacts with an outer end of the first guide part 131. Therefore, the left outer surface 130*b* of the first housing 130 tightly contacts with a second contacting surface C2 of the first power supplying terminal 61. When the first heater 51 is biased to an extreme in the A2 direction, the gap G2 is formed between the second contacting surface C2 and the left outer surface 130*b*. In addition, due to the gap G1, the first heater 51 can move within a range of the gap G2 in the direction A.

As can be appreciated from the above, the first heater 51, the connection units 71 and 72, and the first housing 130 satisfy the relation of following Expression 1:

Expression 1

$$L1-L2>0$$

where, L1 denotes a distance between the first and the second contacting surfaces C1 and C2 respectively for contacting the outer surfaces 130*a* and 130*b* when the first housing 130 thermally expands, and L2 denotes a distance between the first and the second contacting surfaces C1 and C2 respectively for contacting the outer surfaces 130*a* and 130*b* before the first housing 130 thermally expands.

Furthermore, assuming that an L3 denotes a distance by expansion of the first housing 130 by heat from the first heater 51, Expression 2 is satisfied as following:

Expression 2

$$L1-L2=L3$$

By properly constructing the first housing 130, the first heater 51, the power supplying terminals 61 and 63 and connection units 71 and 72 so that Expression 2 is satisfied, and an expanded distance of the first housing 130 can be compensated for. In addition, when the first housing 130 expands, the heater terminals 51*a* and 51*b* comprising the connection units 71 and 72 tightly contact with the left and right outer surfaces 130*a* and 130*b* of the first housing 130, thereby stabilizing the movement of the first heater 51. Also, by the first heater terminal 51*b* in tight contact with the first housing 130 being expanded and the first power supplying terminal 61, movement in the direction B of the first heater 51 is restricted.

Moreover, by the existence of the gap G1, the first housing 130 just expands in the lengthwise or horizontal direction A without affecting the first heater 51, thereby preventing damage of the first heater 51.

According to an embodiment of the present invention, the first heater 51 is applied with greater electric power than the second heater 53. In other words, expansion of only the first housing 130 heated by the first roller 41 is considered. Actually, when the first roller 41 is heated up to approximately 180°, the first housing 130 expands by approximately 2 mm in the direction A (FIG. 6). Therefore, the second housing 140 enclosing the second roller 43 which is heated by relatively lower temperature than the first roller 41 would expand by a very small amount which is ignorable. Therefore, the second heater 53 is fixedly mounted to the second housing 140 from the first.

In an embodiment of the present invention, the second heater terminal 51*b* and the first power supplying terminal 61 determine the distance L1 since those are the portions contacting with the first housing 130 being expanded. However, the embodiments of the present invention are not limited so, but at least one of the first connection unit 71, the heater terminals and the power supplying terminals may be the portion contacting with the first housing 130 when they are all assembled.

With the fusing apparatus for an image forming apparatus, according to an embodiment of the present invention, a predetermined gap is maintained so that the first heater 51 can move with respect to the first housing 130. Therefore, although the first housing 130 thermally expands, the first heater 51 can be fixed in the first housing 130 by compensating for the expanded distance.

Furthermore, by the presence of the gap between the connection unit, for connecting the heater and the power supplying terminal, and the support wall 133*c*, the expansion of the first housing 130 does not affect the connection unit and the first heater 51. Therefore, damage of the first heater 51 is prevented.

While the invention has been shown and described with reference to certain embodiments thereof, it should be understood by those skilled in the art that various changes in form and details may be made therein without departing from the spirit and scope of the invention as defined by the appended claims.

What is claimed is:

1. A fusing apparatus for an image forming apparatus, comprising:

a housing;

a first roller mounted in the housing;

a second roller rotated in contact with the first roller;

a heater movably mounted in at least one of the first and the second rollers and comprising a first heater terminal and a second heater terminal;

a first power supplying terminal and a second power supplying terminal movably supported in the housing; and a pair of connection units movably supported in the housing to connect the respective heater terminals to the corresponding power supplying terminals, wherein, at least one of the heater terminals, the power supplying terminals and the connection units have a predetermined gap with an outer surface of the housing, such that when the housing expands in a lengthwise or horizontal direction of the heater, the outer surface of the housing tightly contacts with at least one of the heater terminals, the power supplying terminals and the connection units, thereby fixing or securing the heater in the housing.

2. The fusing apparatus of claim 1, wherein the housing has a guide part for slidably supporting the connection unit, and the connection unit comprises a nut member movably received in the guide part, and a bolt fastened by the nut member and clamping the heater terminal and the power supplying terminal.

3. The fusing apparatus of claim 2, wherein the nut member comprises:

a non-circular support engaged on the guide part in a sliding manner; and a protrusion formed on the non-circular support by a certain height, wherein the height of the protrusion is greater than a thickness of the guide part.

4. The fusing apparatus of claim 1, wherein the respective connection units are able to move in the lengthwise or horizontal direction and in a direction transversal to the lengthwise or horizontal direction.

5. The fusing apparatus of claim 4, wherein the respective connection units are able to move in the length wise or horizontal direction and in the transversal direction in a state such that the heater terminal and the power supplying terminal are connected.

6. The fusing apparatus of claim 4, wherein the gap is maintained a distance where at least one of the power supplying terminals, the heater terminals and the connection units tightly contact with the housing as expanded, such that the movement in the transversal direction of the connection unit is restricted when the housing expands in the lengthwise or horizontal direction.

7. The fusing apparatus of claim 5, wherein the gap is maintained a distance where at least one of the power supplying terminals, the heater terminals and the connection units tightly contact with the housing as expanded, such that the movement in the transversal direction of the connection unit is restricted when the housing expands in the lengthwise or horizontal direction.

8. The fusing apparatus of claim 4, wherein the lengthwise or horizontal direction and the transversal direction are substantially perpendicular to each other.

9. The fusing apparatus of claim 5, wherein the lengthwise or horizontal direction and the transversal direction are substantially perpendicular to each other.

10. A fusing apparatus for an image forming apparatus, comprising:

a housing;

a heating roller rotatably mounted in the housing;

a heater mounted in the heating roller and having a first heater terminal and a second heater terminal;

a first power supplying terminal and a second power supplying terminal supported by the housing; and a pair of connection units for connecting the respective power supplying terminals to the heater terminals and movably supported by the housing, wherein, when the housing thermally expands in a lengthwise or horizontal direction of the heater, assuming that L1 denotes a distance between contacting portions, the contacting portions of one of the heater terminals, the power supplying terminals and the connection units respectively contacting with both outer surfaces of the housing, and L2 denotes a distance between outer surfaces on opposite sides of the housing, which contact one of the contacting portions, L1 and L2 satisfies a following expression;

$$L1-L2>0.$$

11. The fusing apparatus of claim 10, wherein the housing comprises a guide part for supporting the connection unit so that the connection unit can move in the lengthwise or horizontal direction and a direction transversal to the lengthwise or horizontal direction.

12. The fusing apparatus of claim 10, wherein, assuming that L3 is a distance of expansion in the lengthwise or horizontal direction of the housing by the heat of the heating roller, a following expression is satisfied;

$$L1-L2=L3.$$

13. The fusing apparatus of claim 10, wherein the transversal direction comprises a substantially vertical direction.

14. A method of fusing an image in an image fusing apparatus comprising:

providing a second roller rotated in contact with a first roller;

providing a heater movably mounted in at least one of the first and the second rollers and comprising a first heater terminal and a second heater terminal;

providing a first power supplying terminal and a second power supplying terminal movably supported in the housing; and providing a pair of connection units movably supported in the housing to connect the respective heater terminals to the corresponding power supplying terminals, wherein, at least one of the heater terminals, the power supplying terminals and the connection units have a predetermined gap with an outer surface of the housing, such that when the housing expands in a lengthwise or horizontal direction of the heater, the outer surface of the housing tightly contacts with at least one of the heater terminals, the power supplying terminals and the connection units, thereby fixing or securing the heater in the housing.

15. The method of claim 14, further comprising:

slidably supporting the connection unit via a guide part in the housing.

16. The method of claim 14, further comprising:

movably receiving in the guide part a nut member associated with the connecting part.

17. The method of claim 14, further comprising:

providing a bolt fastened by the nut member for clamping the heater terminal and the power supplying terminal.

18. The method of claim 17, wherein the nut member comprises:

a non-circular support engaged on the guide part in a sliding manner; and a protrusion formed on the non-circular support by a certain height, wherein the height of the protrusion is greater than a thickness of the guide part.

19. The method of claim 14, further comprising:

moving the respective connection units in the lengthwise or horizontal direction and in a direction transversal to the lengthwise or horizontal direction.

20. The method of claim 19, wherein the respective connection units are able to move in the length wise or horizontal direction and in the transversal direction in a state such that the heater terminal and the power supplying terminal are connected.

* * * * *